US006929497B1

(12) United States Patent
Huang

(10) Patent No.: US 6,929,497 B1
(45) Date of Patent: Aug. 16, 2005

(54) CPU SOCKET

(75) Inventor: Huang-Chou Huang, Taipei (TW)

(73) Assignee: Suyin Corporation, Taipei (TW)

( * ) Notice: Subject to any disclaimer, the term of this patent is extended or adjusted under 35 U.S.C. 154(b) by 0 days.

(21) Appl. No.: 10/879,356

(22) Filed: Jun. 30, 2004

(51) Int. Cl.[7] ..... H01R 4/50
(52) U.S. Cl. ..... 439/342
(58) Field of Search ..... 439/342, 259, 439/262, 266, 269.1

(56) References Cited

U.S. PATENT DOCUMENTS 5,569,045 A * 10/1996 Hsu ..... 439/342
6,361,345 B1 * 3/2002 Tan ..... 439/342
6,402,537 B2 * 6/2002 Ikeya ..... 439/259
6,435,893 B1 * 8/2002 Kasahara ..... 439/342

* cited by examiner

*Primary Examiner*—Truc T. Nguyen
*Assistant Examiner*—Felix O. Figueroa
(74) *Attorney, Agent, or Firm*—Dennison, Schultz, Dougherty & MacDonald

(57) ABSTRACT

A CPU socket has a seat has multiple first apertures each with a strip. Two slots are transversally defined beside the first apertures. Two sliding blocks are respectively received in the slots. The stepped sliding blocks each have a first lug formed on a lower step, a second lug formed on an upper step, and a protrusion formed beside the second lug. A cover is movably mounted on the seat and has multiple second apertures corresponding to the first apertures. Two elongated channels are symmetrically and transversally defined through the cover and respectively corresponding to the slots. The first lugs respectively extend out from the elongated channels and are movable along the elongated channels. A notch is defined at a side of the cover adjacent the elongated slots. Two ears are respectively formed at two ends of the notch and each has a groove corresponding to the protrusions.

6 Claims, 7 Drawing Sheets

CPU SOCKET

BACKGROUND OF THE INVENTION

1. Field of the Invention

The present invention relates to a CPU (Central Processing Unit) socket, and more particularly to a CPU socket which can securely fasten pins of a CPU installed thereon.

2. Description of Related Art

A conventional CPU socket is generally composed of a seat, a cover and a control unit. The seat has a plurality of first triangular apertures defined therein. Each of the first triangular apertures has a V-like strip received therein. The cover is movably mounted on the seat and has a plurality of second triangular apertures corresponding to the first triangular apertures. A plurality of channels is respectively defined beside the second triangular apertures and the V-like strips are partially and respectively positioned in the second triangular apertures. The control unit is provided on the cover for longitudinally moving the cover relative to the seat. When a CPU is installed on the conventional CPU socket, pins of the CPU are respectively inserted in the second and first triangular apertures. Whereafter, the control unit is operated to move the cover about the seat, and the parts of the V-like strips in the second triangular apertures are respectively clamped inwards by the channels. Thus, the V-like strips are deformed as a U-like shape, and the pins of the CPU are tightly fastened in the strips.

However, the pins will not be securely fastened if the V-like strips are not deformed enough. Furthermore, the control unit cannot be positioned in the installed status, and may be freely returned to the original position under the resilient force of the deformed strips or an external force, so the CPU will not be appropriately fastened.

Therefore, the invention provides a CPU socket to mitigate or obviate the aforementioned problems.

SUMMARY OF THE INVENTION

The main objective of the present invention is to provide a CPU socket which can ensure that pins of a CPU are reliably installed in the CPU socket and has good electric connection with strips of the CPU socket.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
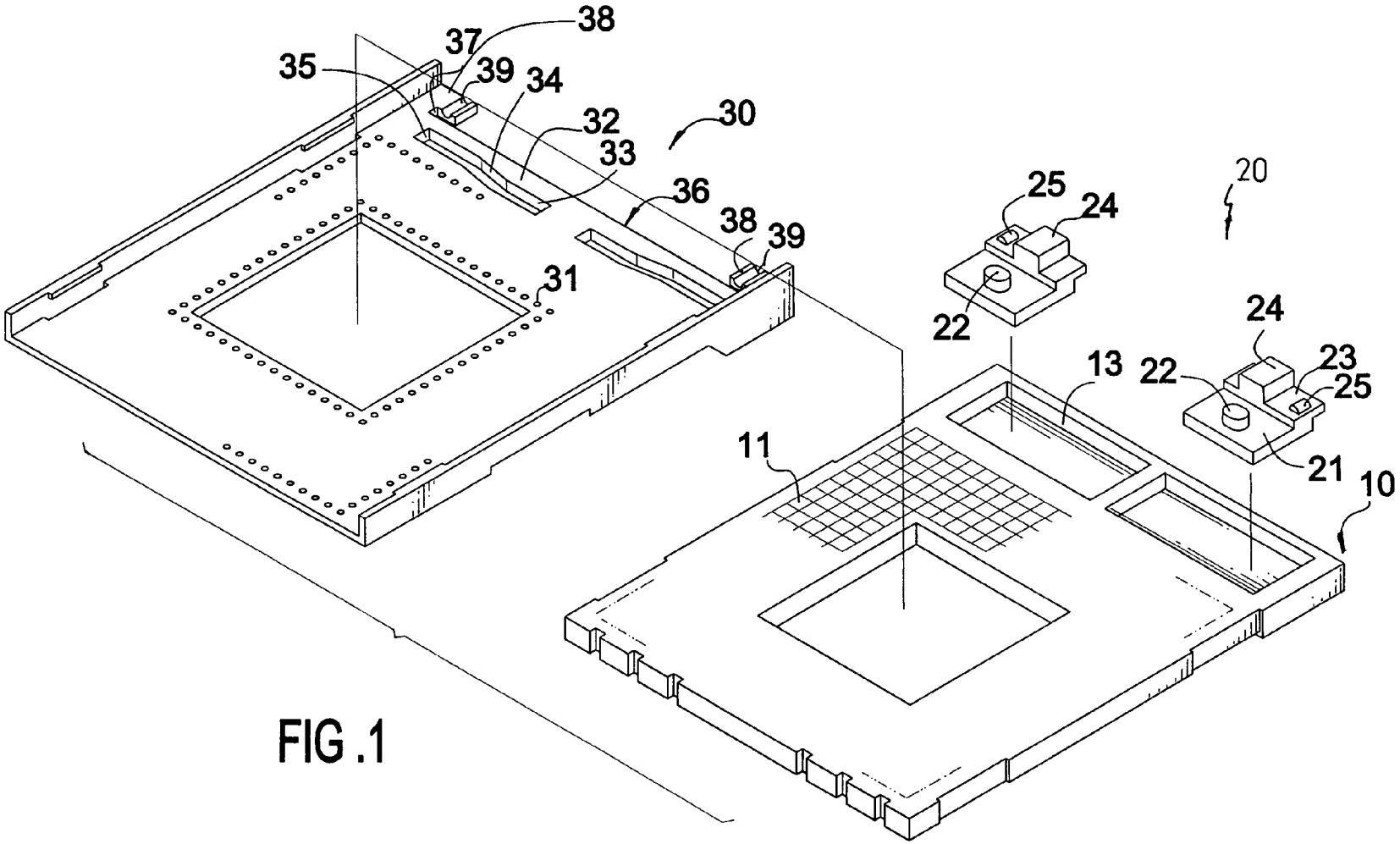
FIG. 1 is an exploded perspective view of a CPU socket in accordance with the present invention.
Figure 2:
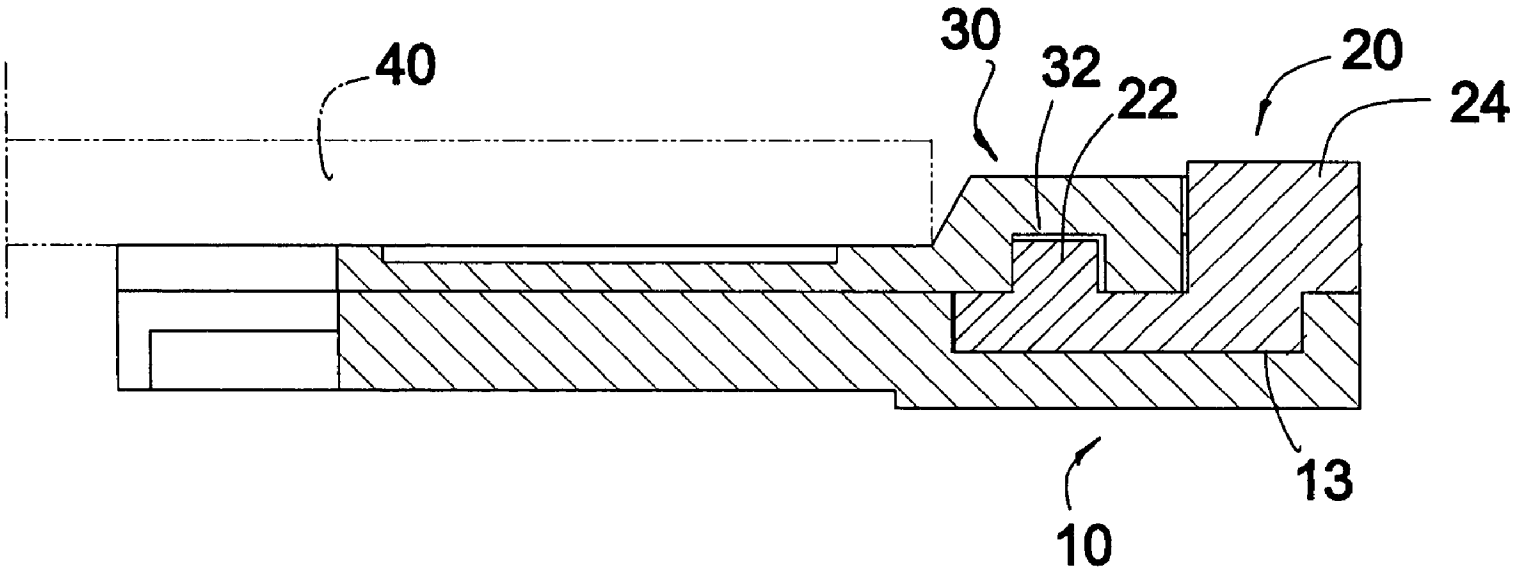
FIG. 2 is a cross sectional view of the CPU socket in FIG. 1.

With reference to FIGS. 1–4, a CPU socket in accordance with the present invention is composed of a seat (10), a pair of sliding blocks (20), and a cover (30). The seat (10) is assembled on a mainboard (not shown) and has a plurality of first apertures (11) to correspond to pins of a CPU (40). The first apertures (11) each have a strip (12) provided therein and electrically connected with a circuit on the mainboard. Two slots (13) are transversally defined beside a first side of the seat (10). (Alternatively, a slot with a length equal to a sum of the two individual slots (13) is acceptable.)

The sliding blocks (20), symmetric to each other, are respectively and movably received in the slots (13). The sliding blocks (20) each have a stepped shape with a lower step (21) and an upper step (23). A first lug (22), which has a circular cross section, is formed on the lower step (21), and a second lug (24) is formed on the upper step (23). A protrusion (25) with a semi-circular cross section is longitudinally formed beside the second lug (24).

The cover (30) is movably provided on the seat (10) and has a plurality of second apertures (31) to correspond to the pins of the CPU (40) and the first apertures (11). Two elongated channels (32) are transversally defined through the cover (30) and respectively corresponding to the slots (13). The elongated channels (32) are symmetric to each other and each have a front segment (33), a middle segment (34), and a rear segment (35) defined from a central portion to a side portion of the cover (30), wherein the rear segment (35) is closer to the first side of the seat (10) than the front segment (33), and the middle segment (34) is inclinedly defined between the front and rear segments (33, 35). The first lugs (22) are respectively extended out from the elongated channels (32) and are movable along the elongated channels (32).

A notch (36) is defined at a side of the cover (30) adjacent the elongated slots (32), and the second lugs (24) extend from the notch (36). Two ears (38) are respectively formed at two ends of the notch (36) and two slits (37) are respectively defined between the ears (38) and the cover (30) and in communication with the notch (36). The ears (38) each have a groove (39) with a semi-circular cross section defined therein and corresponding to the protrusions (25). When the sliding blocks (20) are moved to the respective rear segments (35), the ears (38) can be pushed by the protrusions (25) to be deformed. Thus, the protrusions (25) can be positioned in the respective grooves (39) and the ears (38) are restored to the original status.

Figure 3:
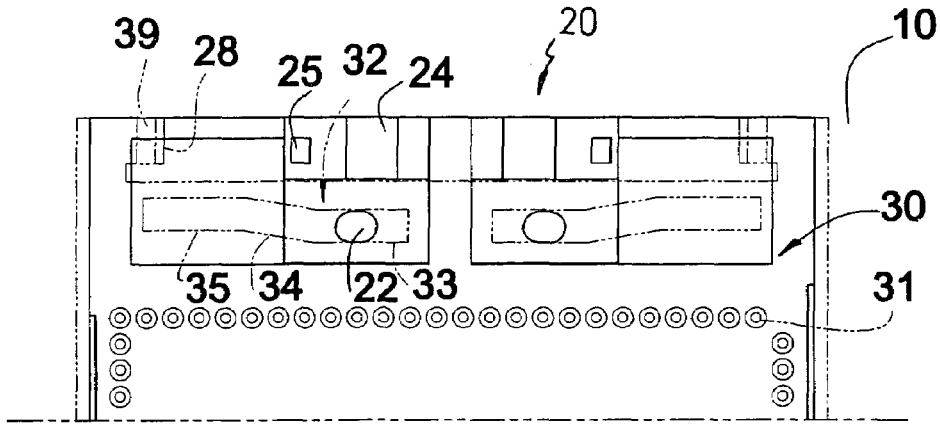
FIG. 3 is a partially top view of the CPU socket.
Figure 5:
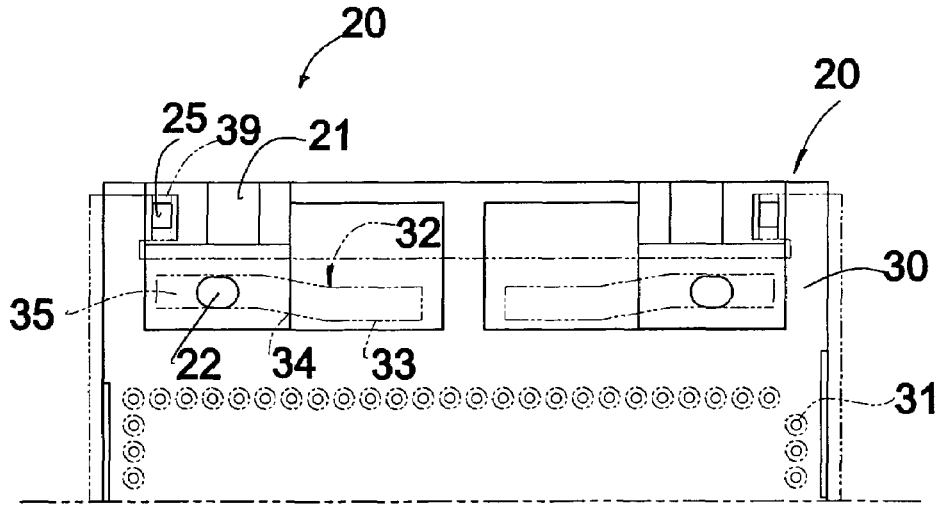
FIG. 5 is another partially top view of the CPU socket.
Figure 6:
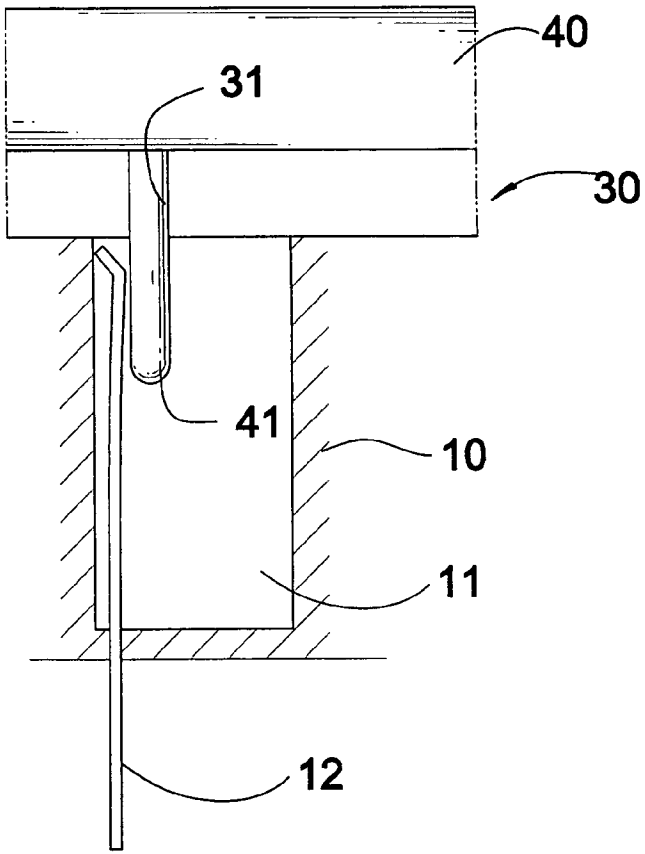
FIG. 6 is another partially sectional view of the CPU socket.
Figure 4:
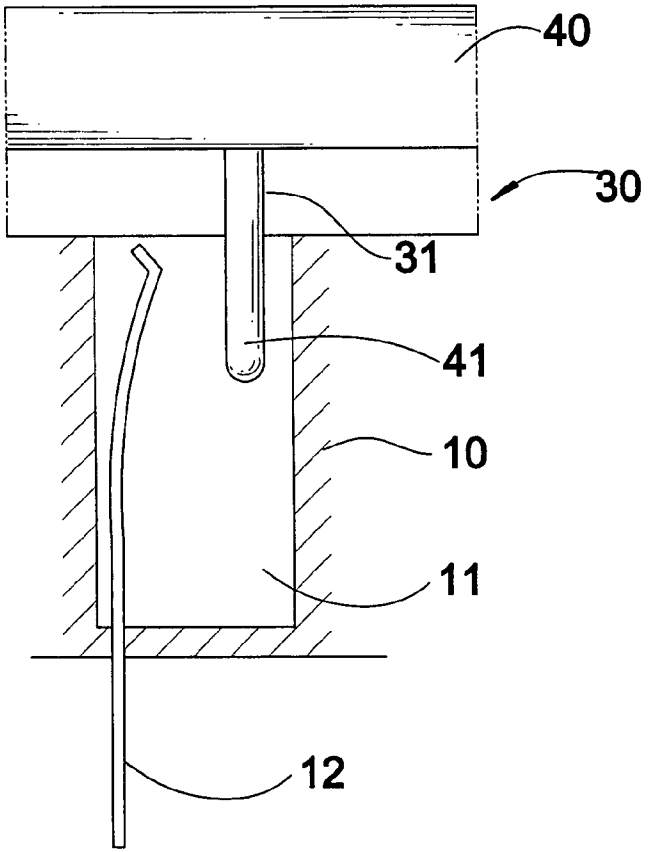
FIG. 4 is a partially sectional view of the CPU socket.
Figure 7:
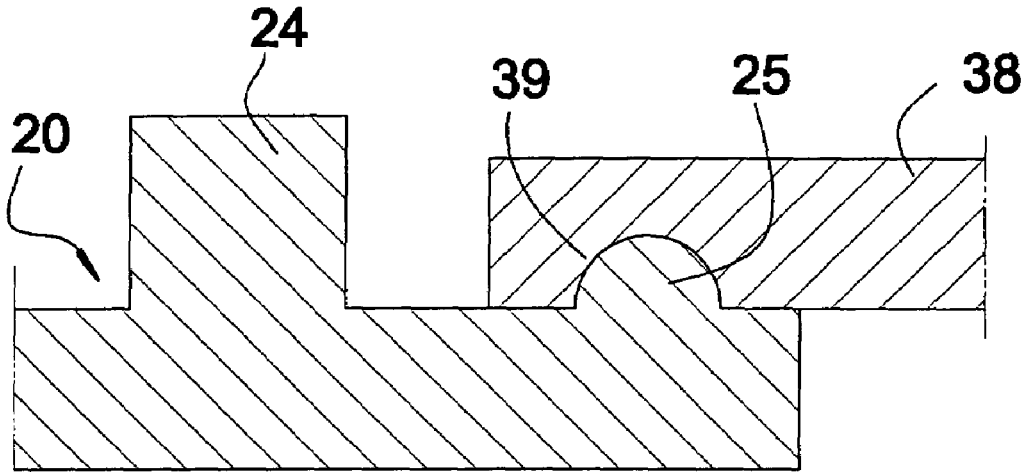
FIG. 7 is a partially cross sectional view of the CPU socket in FIG. 5.

In use, the sliding blocks (20) are first located at a central portion of the seat (10) and the first lugs (22) are located in the respective front segments (33) of the elongated channels (32). The pins (41) of the CPU (40) are respectively inserted through the second apertures (31) of the cover (30) and in the first apertures (11) of the seat (10) but not electrically connected with the strips (12), as shown in FIGS. 3 and 4. Afterwards, a user can hold the second lugs (24) to move the sliding blocks (20) towards the respective rear segments (35) in the elongated channels (32). Meanwhile, the cover (30) is moved towards the first side of the seat (10), as shown in FIG. 5. The ears (38) will be pushed by the protrusions (25) to deform upwards. Thereafter, the protrusions (25) are respectively positioned in the grooves (39) of the ears (38), and the ears (38) are restored to the original status, as shown in FIG. 7. Therefore, the pins (41) of the CPU can be electrically and respectively connected with the strips (12) in the second apertures (11). Because the protrusions (25) are positioned in the grooves (39), the cover (30) is fastened on the seat (10) and the sliding blocks (20) cannot be moved in the slots (13) under the elastic force of the strips (12) or an external force. Thus the pins (41) are securely and electrically connected with the strips (12). For detaching the CPU (40), the user can push the sliding blocks (20) towards the front segment (33) to disengage the protrusions (25) from the grooves (39). Thus, the CPU (40) can be removed from the socket.

Figure 8:
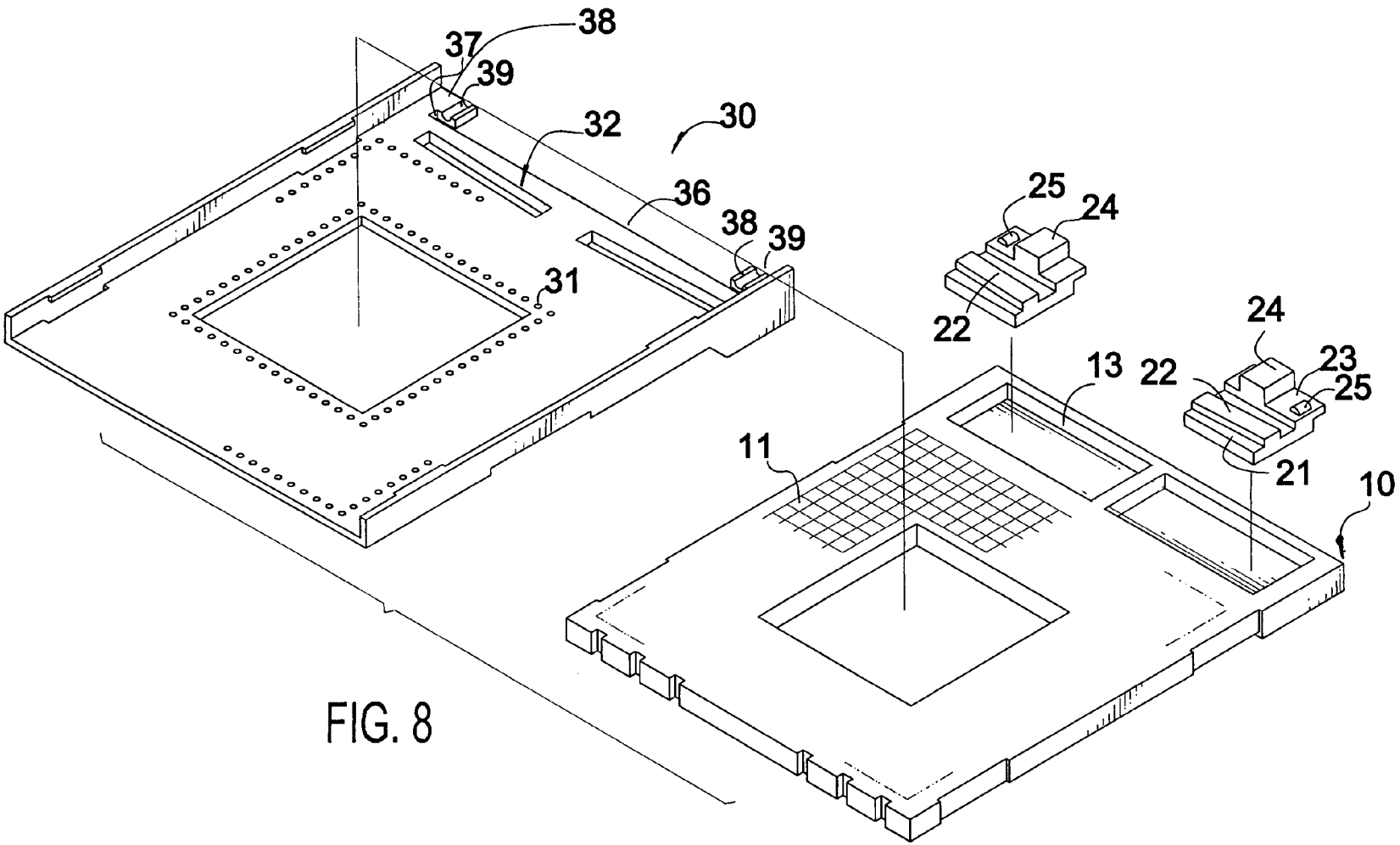
FIG. 8 is an exploded perspective view of another embodiment of the CPU socket in accordance with the invention.
Figure 9:
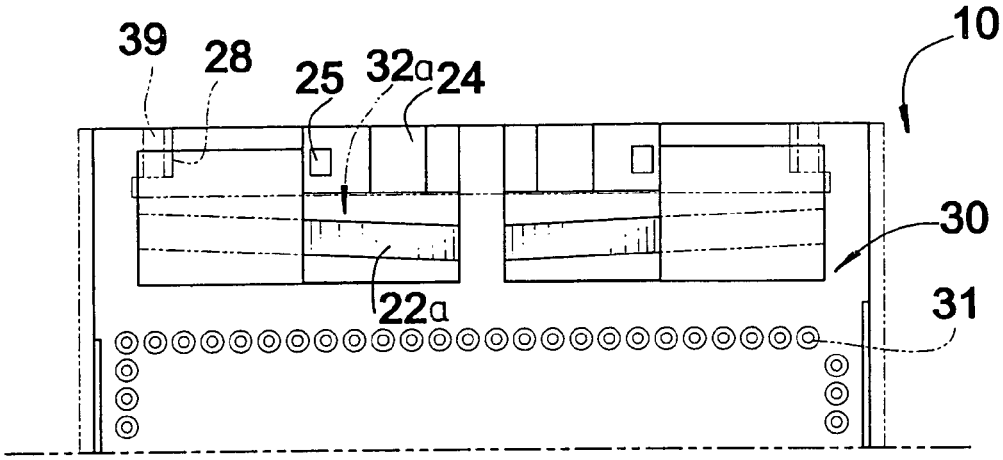
FIG. 9 is a partially top view of the CPU socket in FIG. 8.
Figure 10:
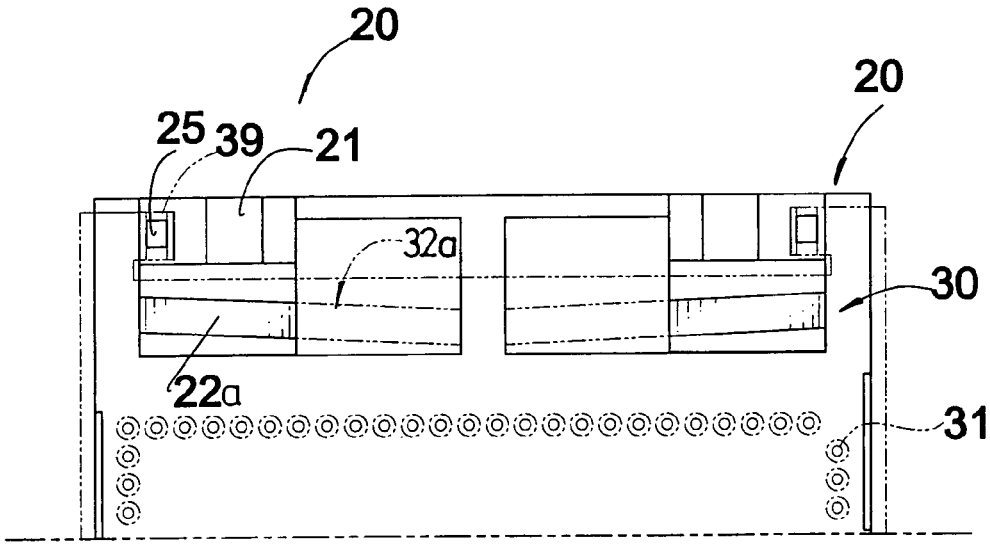
FIG. 10 is another top view of the CPU socket in FIG. 8.

With reference to FIGS. 8–10, in another embodiment of the invention, the sliding blocks (20) each have a first lug (22*a*), with a bar-like shape, inclinedly formed on the lower step (21). The cover (30) has two elongated channels (32*a*) inclinedly defined therein and corresponding to the slots (13). When the user holds the second lugs (24) to push the sliding blocks (20), the first lugs (22*a*) can be respectively moved along the elongated channels (32*a*).

Therefore, according the present invention, by moving the sliding blocks, it is very easy for the user to install/uninstall a CPU. Moreover, the installed CPU is reliably electrically connected with the strips (12) and a possible defective contact in the conventional means is eliminated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A CPU socket comprising:

a seat (10) having a plurality of first apertures (11) each with a strip (12) provided in the respective aperture (11), two slots (13) transversally defined beside the first apertures (11) and near a first side of the seat (10);

a pair of sliding blocks (20) symmetric to each other and respectively received in the slots (13), each sliding block (20) having a stepped shape with a lower step (21) and an upper step (23), a first lug (22) formed on the lower step (21), a second lug (24) formed on the upper step (23), and a protrusion (25) formed beside the second lug (24); and a cover (30) movably mounted on the seat (10), the cover (30) having a plurality of second apertures (31) corresponding to the first apertures (11), two elongated channels (32) symmetrically and transversally defined through the cover (30) and respectively corresponding to the slots (13), the first lugs (22) respectively extended into the elongated channels (32) and movable along the elongated channels (32), a notch (36) defined at a side of the cover (30) adjacent the elongated channels (32) for receiving the second lugs (24) extending from the notch (36), two ears (38) respectively formed at two ends of the notch (36), two slits (37) respectively defined between the ears (38) and the cover (30) and in communication with the notch (36), the ears (38) each having a groove (39) corresponding to the protrusions (25).

2. The CPU socket as claimed in claim 1, wherein the first lug (22) has a circular cross section.

3. The CPU socket as claimed in claim 2, wherein the elongated channels (32) each have a front segment (33), a middle segment (34), and a rear segment (35) defined from a central portion to a side portion of the cover (30), wherein the rear segment (35) is closer to the first side of the seat (10) than the front segment (33), and the middle segment (34) is inclinedly defined between the front and rear segments (33, 35).

4. The CPU socket as claimed in claim 1, wherein the first lug (22*a*) is inclinedly formed on the lower step (21) with a bar-like shape.

5. The CPU socket as claimed in claim 4, wherein the elongated channels (32*a*) are inclinedly defined therein and corresponding to the slots (13) for receiving the first lug (22*a*).

6. The CPU socket as claimed in claim 1, wherein the protrusion (25) has a semi-circular cross section, and the grooves (39) have a semi-circular cross section corresponding to the protrusion (25).

* * * * *